US005640834A

United States Patent [19]

Lerner et al.

[11] Patent Number: 5,640,834

[45] Date of Patent: Jun. 24, 1997

[54] PACKAGING MACHINE AND METHOD

[75] Inventors: Bernard Lerner, Aurora; Richard W. Hess, Hudson; William M. Cronauer, Tallmadge; Rick S. Wehrmann, Hudson; James D. Kramer, Medina, all of Ohio

[73] Assignee: Automated Packaging Systems, Inc., Streetsboro, Ohio

[21] Appl. No.: 488,792

[22] Filed: Jun. 8, 1995

Related U.S. Application Data

[62] Division of Ser. No. 298,786, Aug. 31, 1994, Pat. No. 5,499,485, which is a division of Ser. No. 954,378, Sep. 30, 1992, Pat. No. 5,394,676.

[51] Int. Cl.[6] ..... B65B 43/26; B65B 43/36

[52] U.S. Cl. ..... 53/459; 53/384.1; 53/385.1; 53/468

[58] Field of Search ..... 53/468, 459, 567, 53/384.1, 385.1

[56] References Cited

U.S. PATENT DOCUMENTS

| | | | |
|---|---|---|---|
| Re. 32,963 | 6/1989 | Lerner et al. . | |
| 3,355,857 | 12/1967 | Tobey . | |
| 3,477,196 | 11/1969 | Lerner . | |
| 3,754,370 | 8/1973 | Hanson | 53/385.1 X |
| 3,815,318 | 6/1974 | Lerner . | |
| 3,965,653 | 6/1976 | Lerner . | |
| 4,041,846 | 8/1977 | Lerner . | |
| 4,202,153 | 5/1980 | Lerner et al. . | |
| 4,674,268 | 6/1987 | Gavronsky et al. | 53/468 |
| 4,833,867 | 5/1989 | Reichstahler | 53/385.1 X |
| 4,899,520 | 2/1990 | Lerner et al. . | |
| 5,064,408 | 11/1991 | Bridgeman | 53/385.1 X |
| 5,335,485 | 8/1994 | Cappi et al. | 53/384.1 X |

FOREIGN PATENT DOCUMENTS

| | | |
|---|---|---|
| 207838 | 6/1986 | European Pat. Off. . |
| 0429416 | 5/1991 | European Pat. Off. . |
| 2558704 | 1/1984 | France . |
| 8604038 | 7/1986 | WIPO . |

OTHER PUBLICATIONS

Search report—European patent application 93306802.

*Primary Examiner*—James F. Coan

*Attorney, Agent, or Firm*—Watts, Hoffmann, Fisher & Heinke Co., L.P.A.

[57] ABSTRACT

An improved packaging machine that has improved features for feeding a web in the form of a continuous chain of bags through the machine while helping maintain the web in proper alignment and proper tension, and having additional features for improved loading of the bags. The improved web feed includes a dancer assembly equipped with a pair of nips that are driven at speeds responsive to the rate of web travel through the machine so that tension between a web supply and the dancer nips is isolated from the downstream portions of the web. A web feed mechanism which automatically threads the web through baggers is also provided. The web feed mechanism includes elastic belts which frictionally grip the web to isolate the tension in the section between the dancer nips and the belts from the tension of the web feed mechanism. Nips adjacent the load station and at the downstream end of the web feed mechanism have surface speeds exceeding the surface speed of the belts to maintain tension on the web through the web feed mechanism and effect a slight pre-opening of the bags before they are delivered to the load station. Other features include a cantilevered support of the web supply and bagger, a bagger support which functions as a plenum, an improved dancer assembly, and improved application of compressed air for bag opening.

10 Claims, 14 Drawing Sheets

PACKAGING MACHINE AND METHOD

This is a division of U.S. patent application Ser. No. 08/298,786 filed Aug. 31, 1994, now U.S. pat. No. 5,499,485, which is a division of U.S. patent application Ser. No. 07/954,378 filed Sep. 30, 1992, now U.S. Pat. No. 5,394,676 issued Mar. 7, 1995.

TECHNICAL FIELD

The present invention relates generally to packaging systems and, in particular, to an apparatus and method for forming packages by sequentially loading and separating bags from a web in the form of a chain of interconnected and pre-opened bags.

BACKGROUND

The use of chains of pre-opened bags to form packages is well known. Such chains of bags are disclosed and claimed in U.S. Pat. No. 3,254,828 entitled FLEXIBLE CONTAINER STRIPS (the Autobag patent). A commercial version of a machine described and claimed in U.S. Pat. No. 3,815,318 entitled PACKAGING APPARATUS, and in other patents deriving from the application that resulted in this patent (the H-100 patents), has been sold commercially by Automated Packaging Systems, Inc. under the designation H-100. A machine described in U.S. Pat. No. 4,899,520 entitled PACKAGING APPARATUS AND METHOD includes an ability to use two chains of interconnected bags while packaging and has been sold commercially by Automated Packaging under the designation H-200.

With each of these machines, a pair of driven nip rolls are adjacent a load station. In the majority of cases, a coil of so-called "bags-on-a-roll" is mounted on a mandrel to supply a web in the form of a chain of pre-opened bags to be fed through the machine. During set-up the web is fed from the supply along a path of travel through a so-called dancer arrangement, then through any accessory devices such as imprinters or hole punchers that may be provided, and thence through a section of the machine known as a bagger to the nip rolls. In order to feed the web through the bagger, it is necessary to open or remove a cover and hand-feed the web over and under rolls delineating the path of travel to the nips. While some machines such as that shown and desert bed in U.S. Pat. No. 4,928,455 issued May 29, 1990 under the title "Packaging Machine and Method," facilitate the feed by having certain of the rolls elevated when the covered is opened, the feed of the web during set-up is nonetheless a manual, time-consuming operation.

When the machine is in use, the nip rolls are relied on to pull the web from the supply through the machine. If tensioning of the web through the machine is not consistent, the machine will not function properly and a number of problems can manifest themselves. These problems include improper registration of a bag at the load station with a resultant poor quality package, improper registration of the web through accessory devices with a result that they do not function properly, partial or complete separation of successive bags in the web section disposed along the path of travel which respectively result in poor packages or machine shut-down.

Inconsistent web tension and its attendant problems can result from a number of causes such as improper dancer adjustment, a poorly wound supply coil, the functioning of accessory devices, and in the case of certain machines such as that shown and described in Patent RE 32,963 issued Jun. 27, 1989 under the title "Packaging Apparatus and Method," web feed reversal to effect separation of a loaded bag. In addition, the speed at which these prior machines could operate, do at least in part to limitations of the dancer arm and brake arrangements used, is limited.

Another shortcoming of these prior machines involved changing from a "bags on a roll supply to a wig-wag" box (a box that has the web folded back and forth in multiple rows and layers) supply. In order to change from a roll to a box set-up, an accessory to the machine had to be added, which involved a time-consuming procedure as did the reverse set-up of box to roll.

The H-100, H-200 and competitive machines each have two legs that serve as supports for a bagger. When bags on a roll are used, each supply roll is supported on a mandrel extending between the two legs. Mounting a supply roll supporting mandrel on such a machine is difficult.

Prior to a bag being loaded on an H-100, a burst of air blows the bag open. After the opening of a bag, the bag sometimes is not held open satisfactorily for the loading process. Additionally, the supply of air that keeps the bag open is continuous with the result that excessive quantities of air can be trapped and bag deflators are often required.

With certain types of products, the nip roll assemblies of these bagging machines tend to inhibit the loading of the bags as well as interfere with bag opening air flow. Separation of the nip rolls is difficult and time-consuming if separation is necessary, such as to clear a web jam.

With a standard H-100 machine, the nip roll assembly is located in one fixed "standard" location. If wide bags are used, the standard location of the assembly causes difficulty in opening bags in that the opening tends to be elliptical rather than circular. As a result, loading of the bags is difficult. One solution to this problem with an H-100 is to have an operator manually load the bags and advance the web through use of a foot pedal that caused a stepper motor to drive one of the nip rolls. This slows the bagging process. Another solution is to lower the bag sealing section. This is a tedious and time-consuming procedure.

Another limitation of these machines is they do not function well if the pressure of the air supply is irregular. For example, consistent seal pressure is necessary if high-quality seals are to be formed repetitively and inconsistent seals can result from irregular air pressure.

A further limitation of these machines results if perforations in front and back layers of a web are not in appropriate longitudinal registration. Detectors on these machines cannot properly detect the ends of bags if the perforations are offset longitudinally because when perforations of one layer are aligned with a detector, the other layer interferes with the detection.

Disclosure of the Invention

The present invention provides an improved packaging machine that has improved features for feeding a web in the form of a continuous chain of bags through the machine while maintaining the web in proper alignment and proper tension, and having additional features for improved loading of the bags.

In the preferred embodiment, a packaging machine for loading bags has an upstanding support section mounted on a base at a location offset to one side of the base. A dancer assembly is mounted on the base. A web supply positioner is cantilevered from and connected to a frame of the dancer assembly. The positioner projects laterally from the dancer assembly frame at a bag supply station above the one side of the base toward the other side. Because there is only a single, upstanding support section, a supply roll for the web can be quickly and easily mounted on the positioner.

A web dispensing section in the form of a bagger is mounted on the support section above the positioner and the dancer assembly. The bagger includes a web feed mechanism which extends to a lead station. The web feed mechanism and the dancer assembly co-act to provide one of the outstanding features of the present invention. Together, they segregate the web path of travel into three sections in each of which tension is controlled without effect on the other sections.

More specifically, nip rolls of the dancer assembly feed the web evenly from the supply roll no matter how badly wound that supply roll is. Any irregularities in the tension caused by a badly wound roll are isolated from downstream sections of the web path of travel by the dancer nips. Belts of the web feed mechanism grip the web as it enters the feed mechanism with the result that the section between the dancer and the web feed has tension maintained by the dancer independent of any effects on tension in the other two sections. This enhances the operation of any accessory devices. The third section is in the web feed mechanism where the difference between the surface speed of the nips adjacent the lead station and the belts of the feed mechanism assures tension control through the feed mechanism independent of web tension in the upstream sections.

The dancer assembly includes upper and lower dancer roll sets and upper and lower dancer frames respectively carrying the upper and lower sets. The frames are pivotally connected together and are selectively, relatively positionable in a web feed position or in a Web tension control range. When the upper frame is in the web feed position, the upper roll set is on one side of an imaginary plane located by the axes of the upstreammost and downstreammost rolls of the lower set. This allows facile feeding of a web through the assembly for set up. When the upper frame is in the tension control range, the upper set is on the opposite side of the imaginary plane.

In order to sense relative frame pivoting in the tension control range, a segment of a gear is connected to the frame pivot and a meshing "pot gear" is connected to a potentiometer. At least one of the dancer nip rolls is connected to a stepper motor. The pot gear is rotated in response to the relative motion of the roll sets in the control range and controls the stepper motor via the potentiometer in response to such roll set motion to control the feed rate of the web from the web supply. This causes the driven dancer nip roll to feed the web at appropriate rates while the dancer roll sets maintain proper tension and alignment. This proper tension and alignment is maintained even when feed of the web is reversed from the load station for bag separation.

In the preferred machine, the bagger projects laterally from the support section toward the other side of the base section in a cantilever fashion. The web feed mechanism of the bagger includes an opposed pair of sets of elastic conveyor belts respectively positioned on opposite sides of the web path of travel. Upstream and downstream opposed pairs of spaced roll members are also respectively positioned on opposite sides of the path. Each of the sets of belts is stretched around the roller pair on the like side of the path to delineate, as to each belt, a feed reach adjacent the path and a return reach spaced from the path. A stepper motor is coupled to one of the roll members of each pair to rotate the coupled members and thereby cause the feed reaches to move in directions toward the load station for web feed. Additionally, the stepper motor reverses the direction of the feed reaches for bag tear-off after a bag has been loaded and as it is sealed.

Grooves are provided in the roll members to receive the belts. Each of the grooves in the downstream roll pair, which are load station nip rolls, has a radial depth slightly greater than the diameter of the belts so that the linear speed of the belts is less than the surface speed of the load station nip rolls. Because of this speed differential, the belts place a drag on the web to help to maintain proper tension within the web, and the nips function to slightly pre-open each bag.

Because the bags are slightly pre-opened, reliable full opening at the load station is facilitated. In addition, slightly longitudinal offset perforations of the front and back of a bag in the web are no longer a problem. A spark detector that detects perforations for controlling advancement of the web can now detect the perforations in the back of a bag without hindrance from the front. To this end, the spark detector is located a short distance upstream from the load station nip rolls so that detection of the perforations is at a location where the bags are partially pre-opened.

The load station nip rolls are located one above the other with an upper one of the nip rolls offset rearwardly relative to a lower one along the path of web travel. Since the upper roll is offset, loading is facilitated and product access to the bag is "clearer." Also, equipment optionally added to the machine to assist in loading the bags can be mounted closer to a bag positioned at the load station than was the case with prior machines.

In the preferred embodiment, the upstream roll members are offset longitudinally of the path of travel. In addition, the rolls of the upstream pair and one of the downstream rolls have axes located in a common plane. When the path of belt reach travel is horizontal, the common plane is also horizontal. The belts of one conveyor are each in the shape of an elongate oval with their feed reaches substantially horizontal. The feed reaches of the other conveyor stretch from the offset upstream roll, downwardly under the other roll of the upstream pair and then substantially horizontally forward.

The described offset arrangement of the upstream roll pair of the web feed mechanism provides another of the outstanding features of a machine of this invention in that the belts provide self-threading web feed through the bagger during set-up. Thus, the web feed through the feed mechanism only requires manual feed of the web to its entrance and "jogging" of the machine to thread the web through the mechanism. To unthread the machine or to correct a problem if, for example, initial feeding of a new web has become skewed, the jogging can be reversed to back the web out of the mechanism.

The load station nip rolls together with their support form a nip roll assembly. The nip roll assembly is easily mounted in either of two mounting positions. Which of the two positions is selected depends upon an operator's choice based upon the sizes of bags and products being loaded. For example, with wide bags, the loading position should be further from the air knife than narrow bags to provide a better opportunity for the airflow to effect desired circular openings.

The upper load station nip roll is spring biased against the lower roll. The rolls can be separated by actuation of an adjustment lever that rotates a cam to force the upper nip roll away from the lower nip roll against the spring force. Roll separation is desirable for such purposes as servicing the belts or clearing a jam.

The support section includes an internal chamber that provides a portion of an air manifold. Additionally, the bagger is connected to the support section by a tube that also defines an internal chamber. The tube chamber communicates with the support chamber to define a further portion of the air manifold. The manifold functions as a plenum to provide air under substantially uniform pressure to the packaging machine, even with an inconsistent external air supply.

The web supply positioner also allows for quick and easy change-over from a supply roll to a wig-wag box supply. With the present machine, simple positioning of a roller placed above a wig-wag box location adjacent the positioner is all that is required, as opposed to an inconvenient accessory that is time-consuming to attach as has been the case in the past.

An input module is connected to the support section and electrically connected to electronic controls for allowing operator input to the controls. The electronic controls are contained in a shielded module that is a removable section of the bagger. The electronic controls include a controller board defining a bus system and one or more auxiliary boards coupled to the bus system. Because the control module is removably connected to the remainder of the bagger, the control module can readily be lifted out as a unit for replacement or repair and maintenance.

Both the bagger and the input module are individually pivotable with respect to the support section. This allows operator positioning of both the bagger and the input module to suit the type of items being packaged and to suit the operator's preference.

Accordingly, the objects of the invention are to provide an improved packaging machine for loading products into bags from a web in the form of a continuous chain of bags while maintaining proper web alignment and tension as the web is fed through the machine and a method of packaging.

These and other features and objects of the invention will be better understood after considering the detailed description in conjunction with the drawings.

DESCRIPTION OF THE PREFERRED EMBODIMENT

Figure 1:
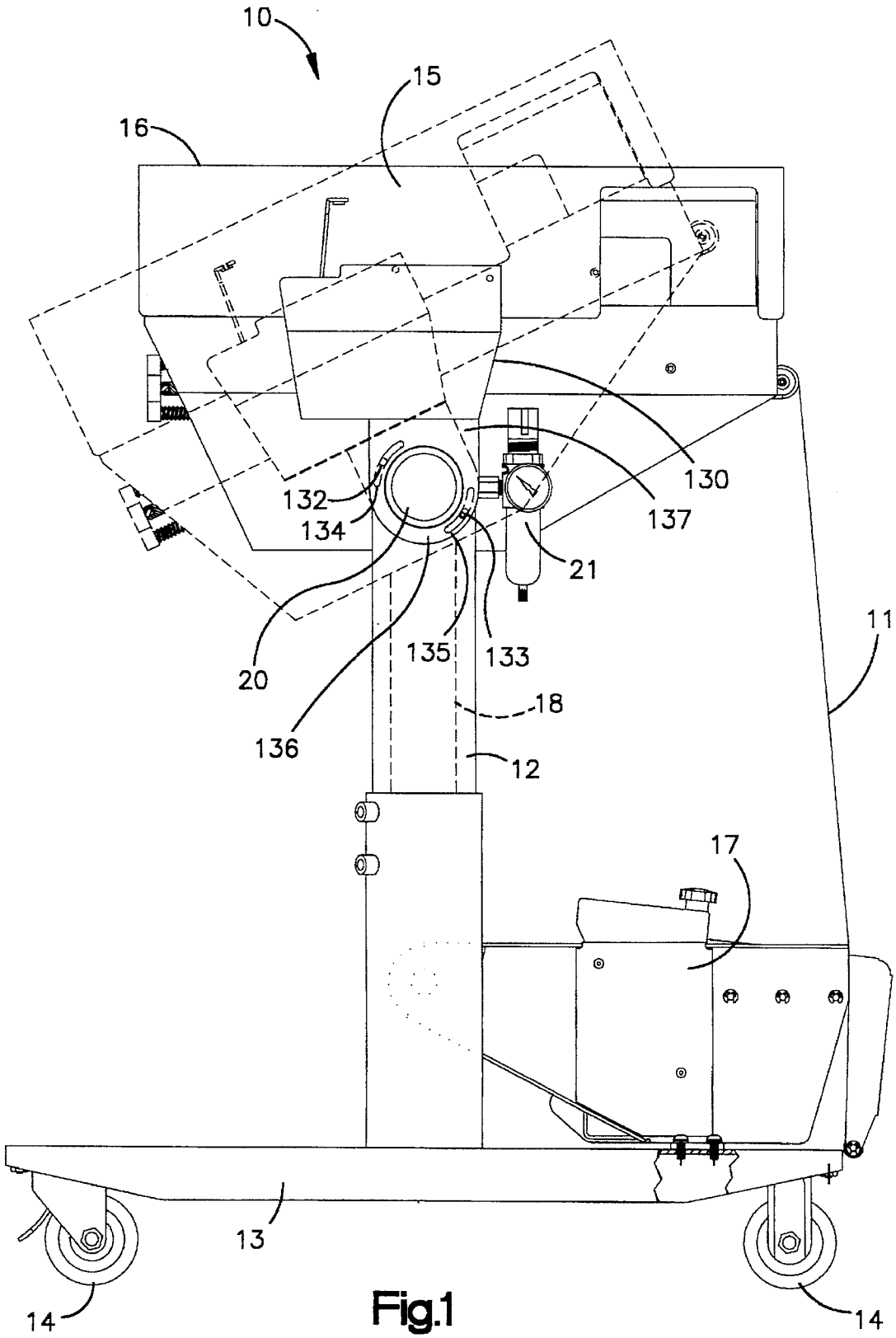
FIG. 1 is a side elevational view of a packaging machine embodying the present invention.

Referring to the drawings, a packaging machine constructed in accordance with a preferred embodiment of the invention is illustrated generally at 10. The machine 10 is constructed to load bags from a web 11 in the form of an interconnected chain of open bags. The bags are preferably connected together along lines of weakness so that each bag can be separated from the web after it has been loaded with a product.

The packaging machine 10 includes an upstanding support frame 12 that sits atop a base 13. The base 13 is supported by rollers 14 that allow the packaging machine 10 to be moved easily. The packaging machine 10 further includes a bagger 15 that is cantilever mounted on the support frame 12. The bagger includes a removable housing or cover 16 that encloses the bagger and covers a bagger web feed mechanism M, FIG. 6. A web supply and tensioning device 17 is connected to base 13 below the bagger 15.

Figure 5:
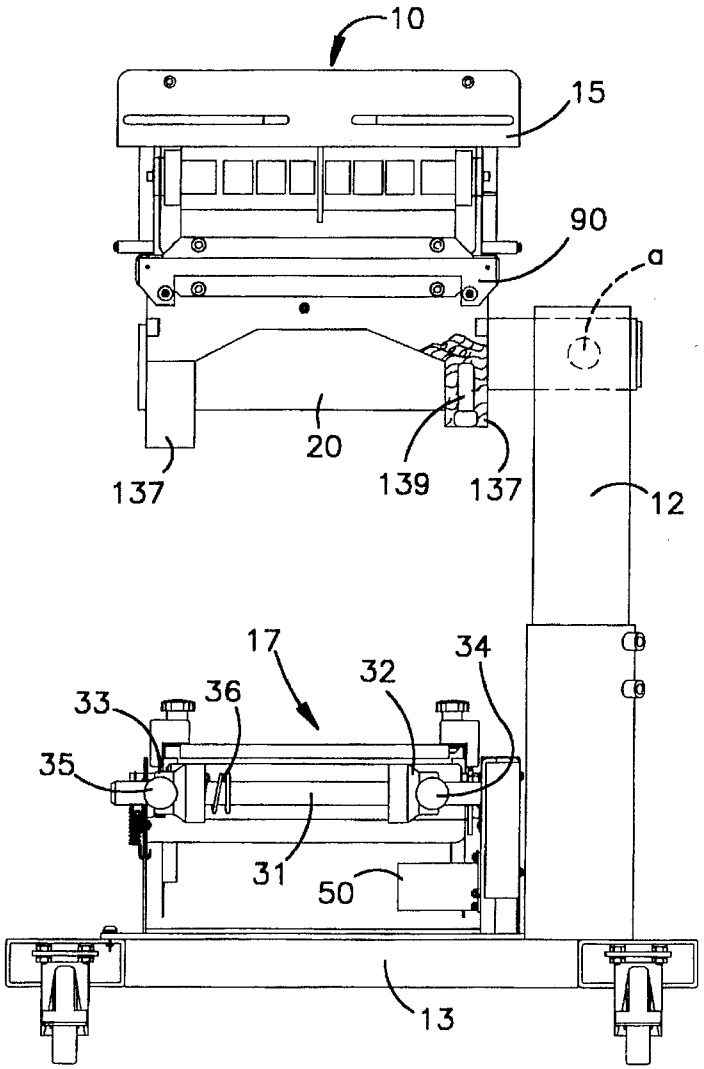
FIG. 5 is a front elevational view of the packaging machine of FIG. 1 on a reduced scale.
Figure 4A:
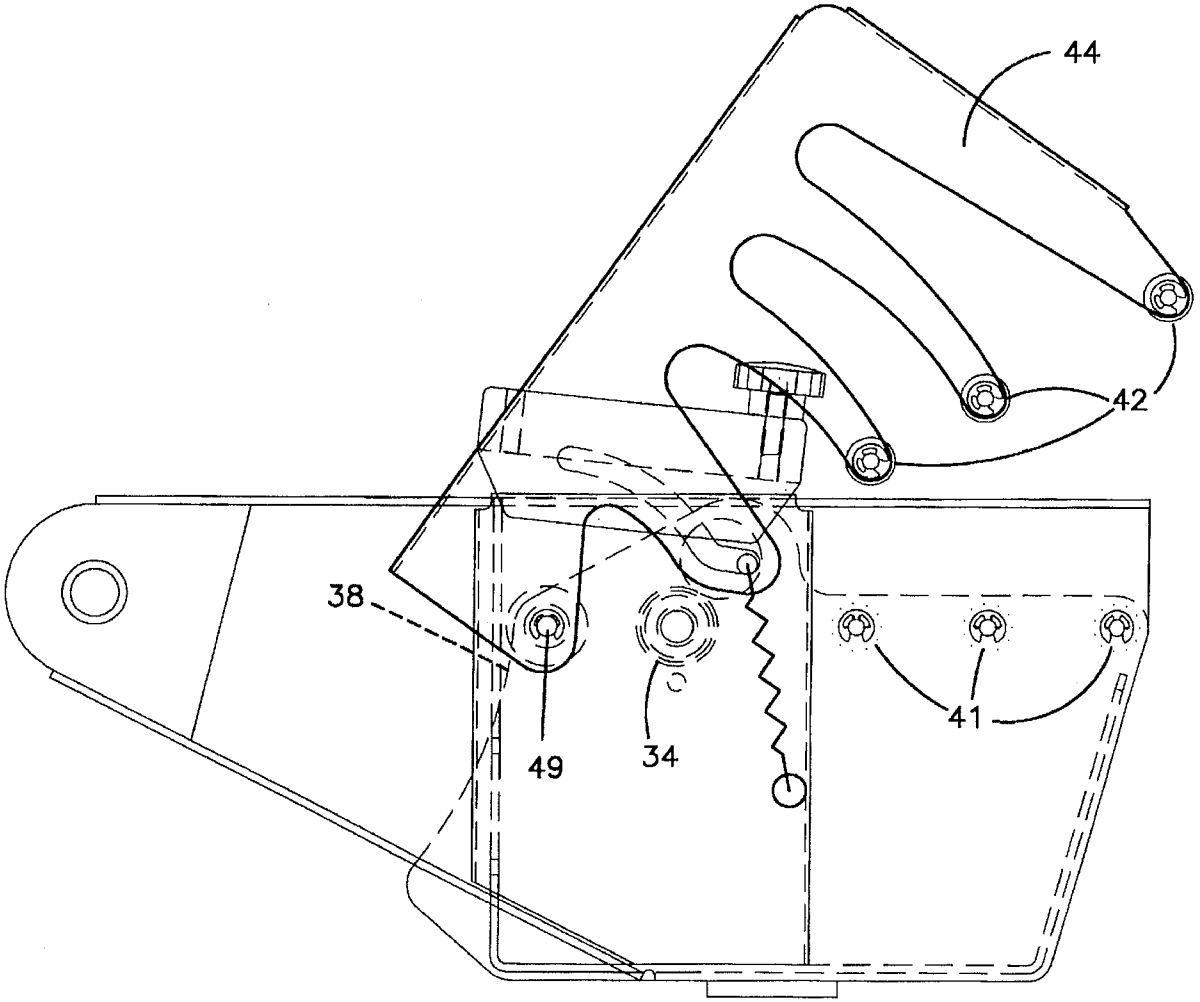

The support frame 12 is preferably a hollow, single-leg frame that is, as is best seen in FIG. 5, laterally offset to one side of the base 13. An enclosed inner chamber 18 (FIG. 1) of the support frame forms a portion of an air manifold. A support arm 20 projects laterally from the support frame 12. The arm 20 is the cantilever support for the bagger 15. The arm 20 is also preferably hollow to provide an air chamber which is in communication with the chamber 18 to form a further portion of the air manifold. To this end, the tube 20 projects through and is secured to the stand 12, FIG. 5. Apertures A in the arm 20 provide fluid communication between the chambers of the stand and the arm.

An air regulator 21 is connected to the support frame 12 and is connectable to an external air supply source (not shown). The air regulator allows air from an external source to enter the air manifold and maintain the air within the manifold at a desired pressure. A set of connectors 22 are provided along the support arm for connection of accessories (not shown). If an accessory requires a reduced air pressure, an air regulator can be attached to a connector in order to adjust the pressure of the air supplied by the manifold.

The Web Supply and Tensioning Device 17

Figure 3:
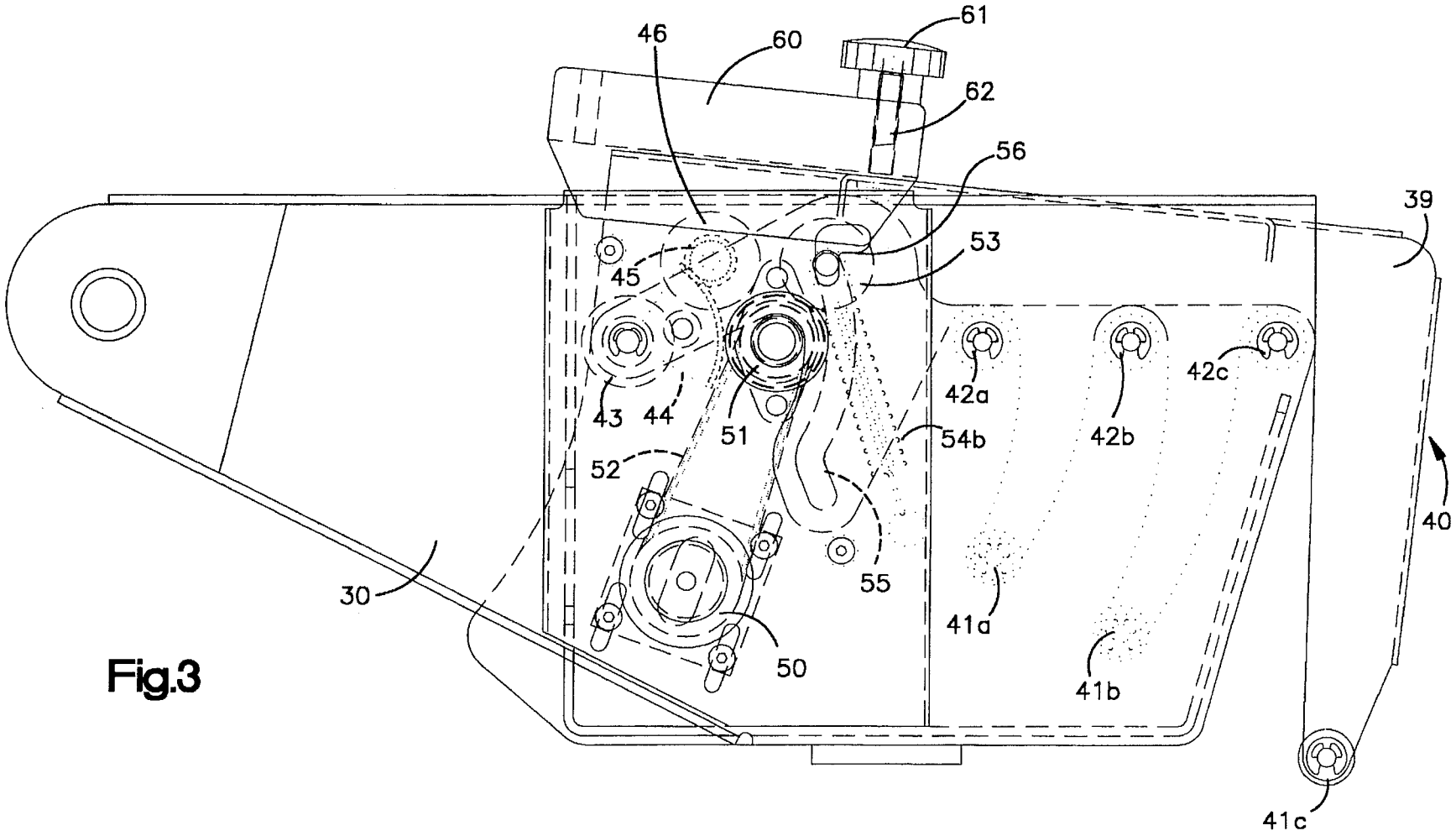
FIG. 3 is an enlarged sectional view of a web supply and tensioning device of the packaging machine.
Figure 11:
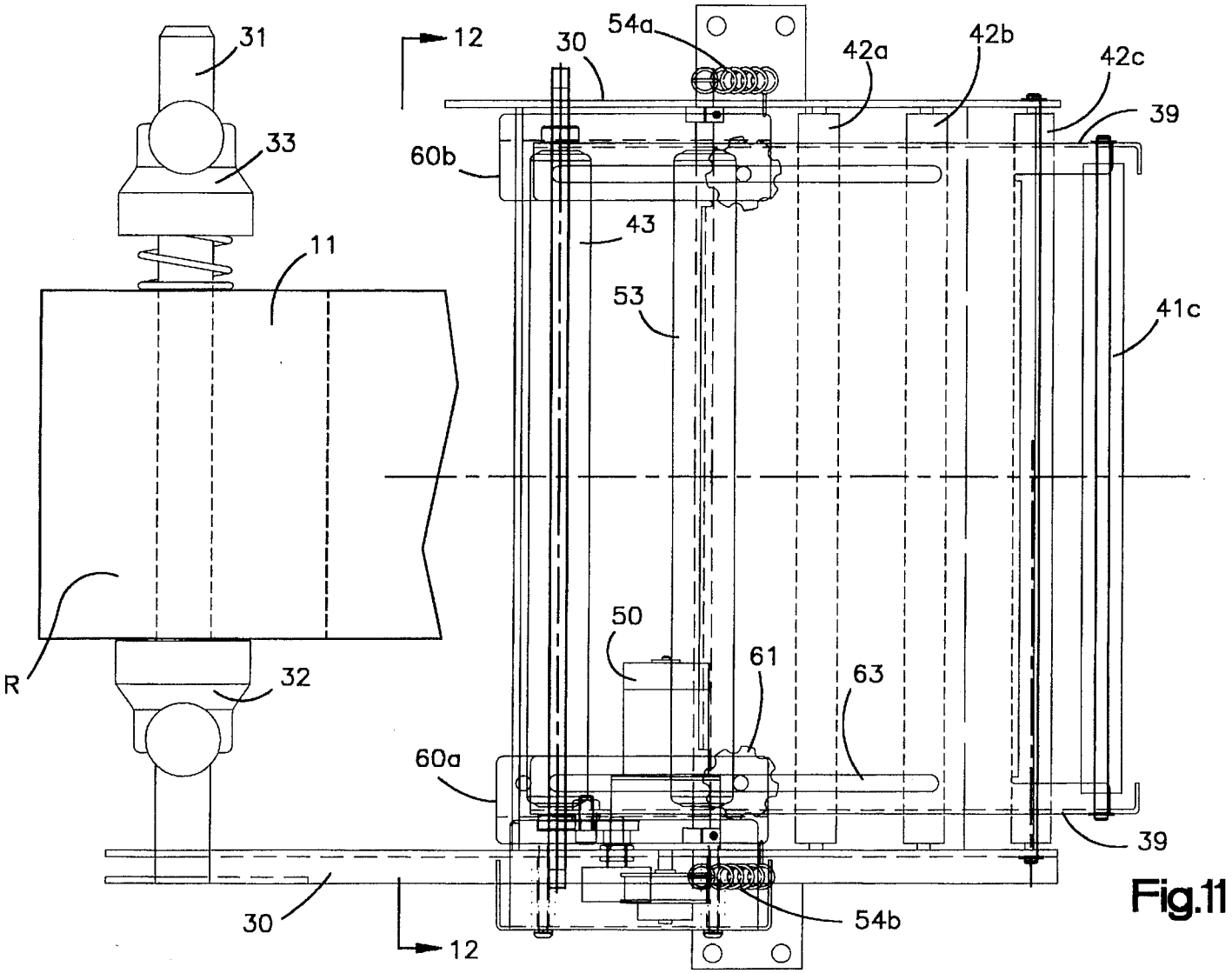
FIG. 11 is a top plan view of the web supply and tensioning device of FIG. 3 with parts broken away and removed.
Figure 12:
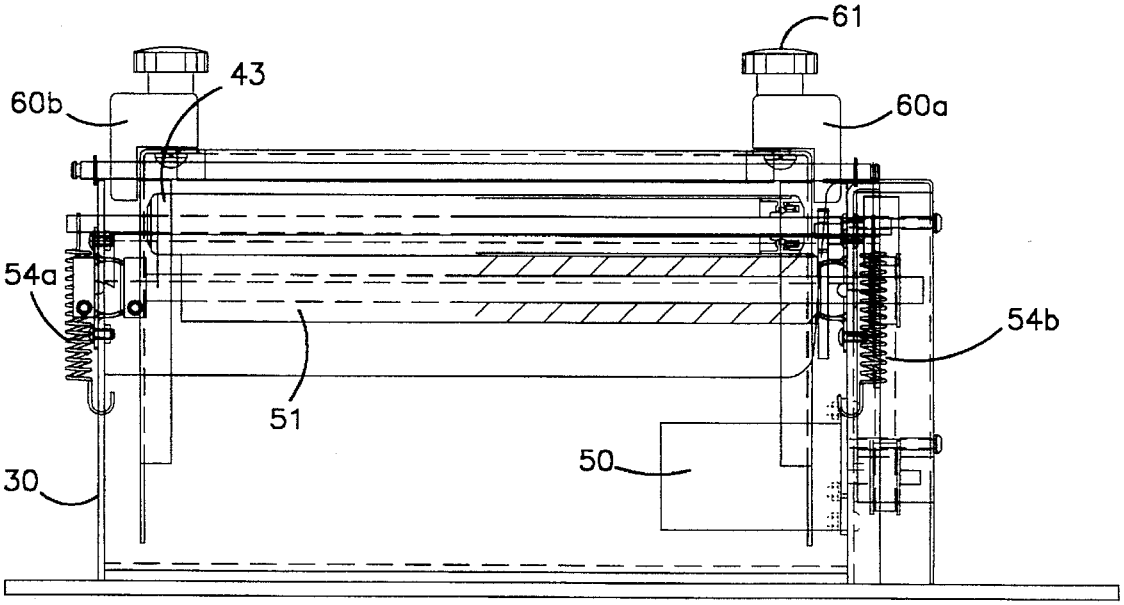
FIG. 12 is a front elevational view of the web tensioning device of FIG. 3 as seen from the plane indicated by the line 12—12 of FIG. 11.
Figure 13:
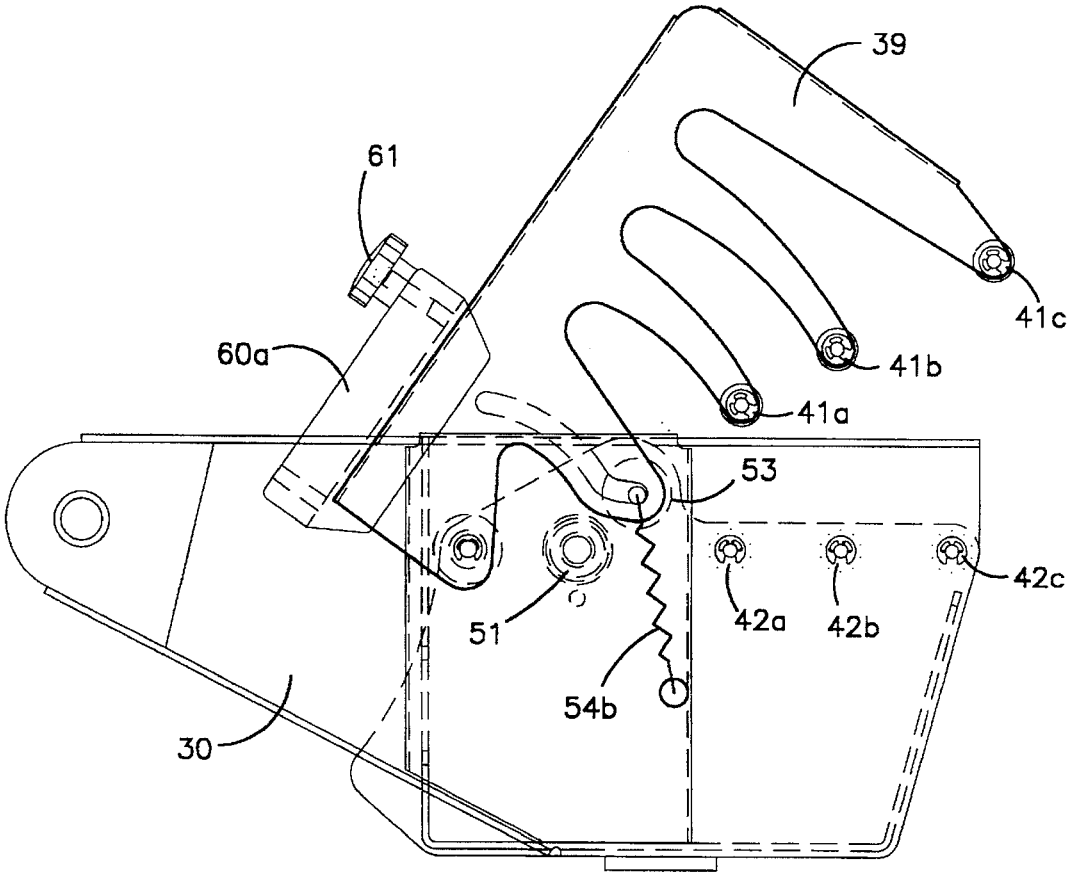
FIG. 13 is a reduced scale side elevational view of the web tensioning device of FIG. 3 illustrating an upper set of dancer rolls in an upright position.

As best seen in FIGS. 3, 11 and 13, the web supply and tensioning device 17 includes a lower frame 30 and a cantilevered supply shaft 31 for carrying a roll of bags R. A roll positioning hub 32 is mounted on the supply shaft near an end connected to the frame 30 while a hub assembly 33 is mounted at its opposite end. The two hubs 32, 33 have knobs 34, 35 for clamping of the hubs onto the shaft in adjusted positions along the shaft. In order to mount a supply roll to the supply shaft 31, the hub assembly 33 is removed from the supply shaft and a supply roll is slid onto the shaft. The hub assembly 33 is placed back on the supply shaft and is slid up against the supply roll such that a spring 36 of the hub assembly 33 is against the supply roll in order to bias the supply roll against the positioning hub 32 while allowing the roll to rotate freely.

The tensioning device 17 also includes an upper frame 39 which carries an upper dancer roll set 40. The upper frame 39 is pivotally connected to the lower frame 30 and is pivotable with respect to the remainder of the tensioning device about an axis co-axial with an idler roll 43. The upper dancer roll set has three idler rolls 41*a*, 41*b*, 41*c*. Three lower idler rolls 42*a*, 42*b*, 42*c* are carried by the lower frame 30 and form a lower roll set. The upper and lower rolls define a section of a web path of travel with the lower rolls being respectively laterally offset rearwardly of the path of travel with respect to the upper rolls.

With the machine set-up shown in the drawings, the web path of travel begins with the supply roll R, passes over the idler roll 43 and continues through the web tensioning device. The idler roll 43 is mounted on the frame 30 along the pivot axis of the upper dancer roll set 40 and its shaft serves as the pivot for the upper set.

A segment of a gear 44 is attached to the upper frame 39 so that it pivots with the upper dancer roll set 40 about the axis of the idler roll 43. The gear segment 44 is in mesh with a "pot gear" 45 that is connected to a potentiometer 46. This pot gear 45 causes pot rotation in response to the rotation of the gear segment 44 and thereby "informs" the potentiometer of the position of the upper dancer roll set 40.

A stepper motor 50 is controlled by the potentiometer 46 and drives a drive roll 51 via a toothed belt 52. The drive roll 51 has an idler roll 53 nipped against it to form a nip roll assembly. This nip roll assembly contributes to the definition of the web path of travel and provides one of the features of the invention. This assembly pulls the web from the supply roll R and functions to isolate tension effects of the supply roll in the feed section of the path of travel from sections of the web path which are downstream from the nip assembly.

The nip roll 53 is biased against the drive roll 51 by two springs 54*a*, 54*b*. When the upper dancer roll set 40 moves up and down, a shaft of the nip roll travels within a slot 55 provided by the upper frame 39. A second slot is on an opposite side of the frame 39, but is not illustrated. When the upper dancer roll set 40 is fully raised into its web feed position, as illustrated in FIG. 13, the springs 54*a*, 54*b* are stretched and the nip roll 53 is pulled away from the drive roll 51 to move its axial shaft into offset end sections of the slots 55 and to horizontal sections of slots 56 defined within the frame 30. This retains the upper set in the position of FIG. 13 to facilitate set-up feeding of the web between the nip roll and the drive roll and through the tensioning device.

Since physical properties of webs which can be fed through the machine fall in a wide range, a tension adjustment of the dancer assembly is required. Accordingly, two counter weights 60*a*, 60*b* are provided. Each counter weight has a control knob 61 that threadedly engages a screw 62 located in a corresponding slot defined by the upper frame 39. By loosening and tightening the knob, the counter weight can be shifted appropriately along an upper guide portion of the frame 39 to adjust the amount of tension applied to the web. The counter weights are small and compact as contrasted with dancer arms used with previous machines.

In operation, the web is fed from a supply roll R carried by the supply shaft 31 over the idler roll 43 and between the nip roll 53 and drive roll 51. When the upper dancer roll set 40 is in its web feed position of FIG. 13, the web is laid across the three lower rolls 42*a*, 42*b*, 42*c*. The drive roll shaft is then manually moved out of the offset sections of the slots 55 and the horizontal sections of slots 56. The upper dancer roll set is then lowered until the upper dancer rolls 41*a*, 41*b*, 41*c* engage the web and push it down such that the web is now woven over each lower roll and under each upper dancer roll in a "zig-zag" fashion.

When the packaging machine 10 is operating and the web is being drawn through the bagger 15, the upper dancer roll set 40 moves upwardly thereby causing the gear segment 44 to pivot in conjunction with the upper dancer roll set movement which, in turn, rotates the pot gear 45. The potentiometer thereby "instructs" the stepper motor to drive the drive roll 51 to feed the web from the supply roll to increase the volume of web in the web tensioning device 17. This allows the upper dancer roll set 40 to move downwardly against the web. This, in turn, causes the segment of the gear to move the pot gear, which causes the potentiometer to "instruct" the stepper motor to slow its driving of the drive roll 51. In this manner, the upper dancer roll set 40 moves up and down in a tension control range to control the tension of the web.

The Bagger Feed Mechanism M

Figure 2:
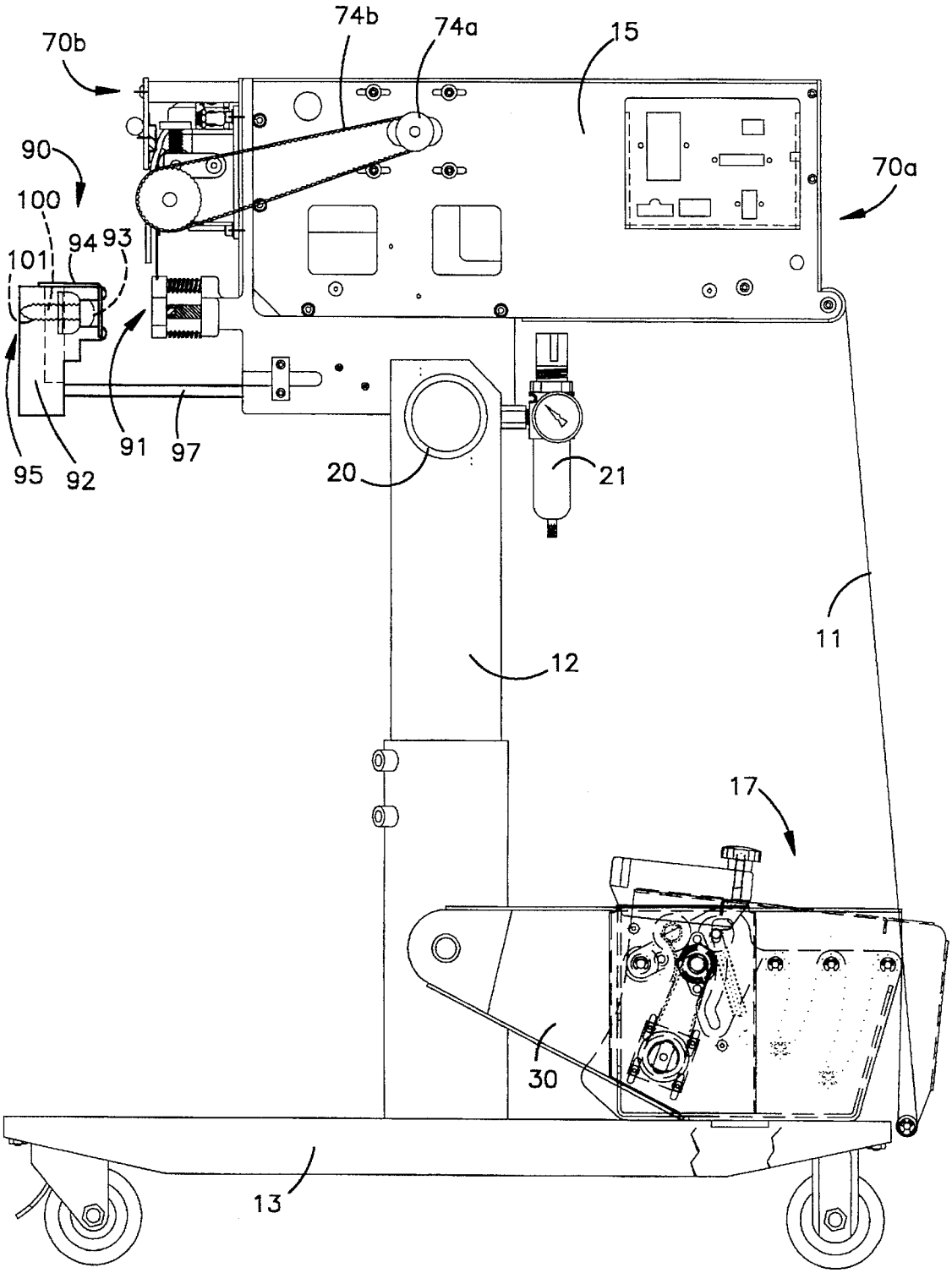
FIG. 2 is a side elevational view of the packaging machine of FIG. 1 with parts of the bagger broken away and removed and a partial sectional view of a web tensioning device.
Figure 2A:
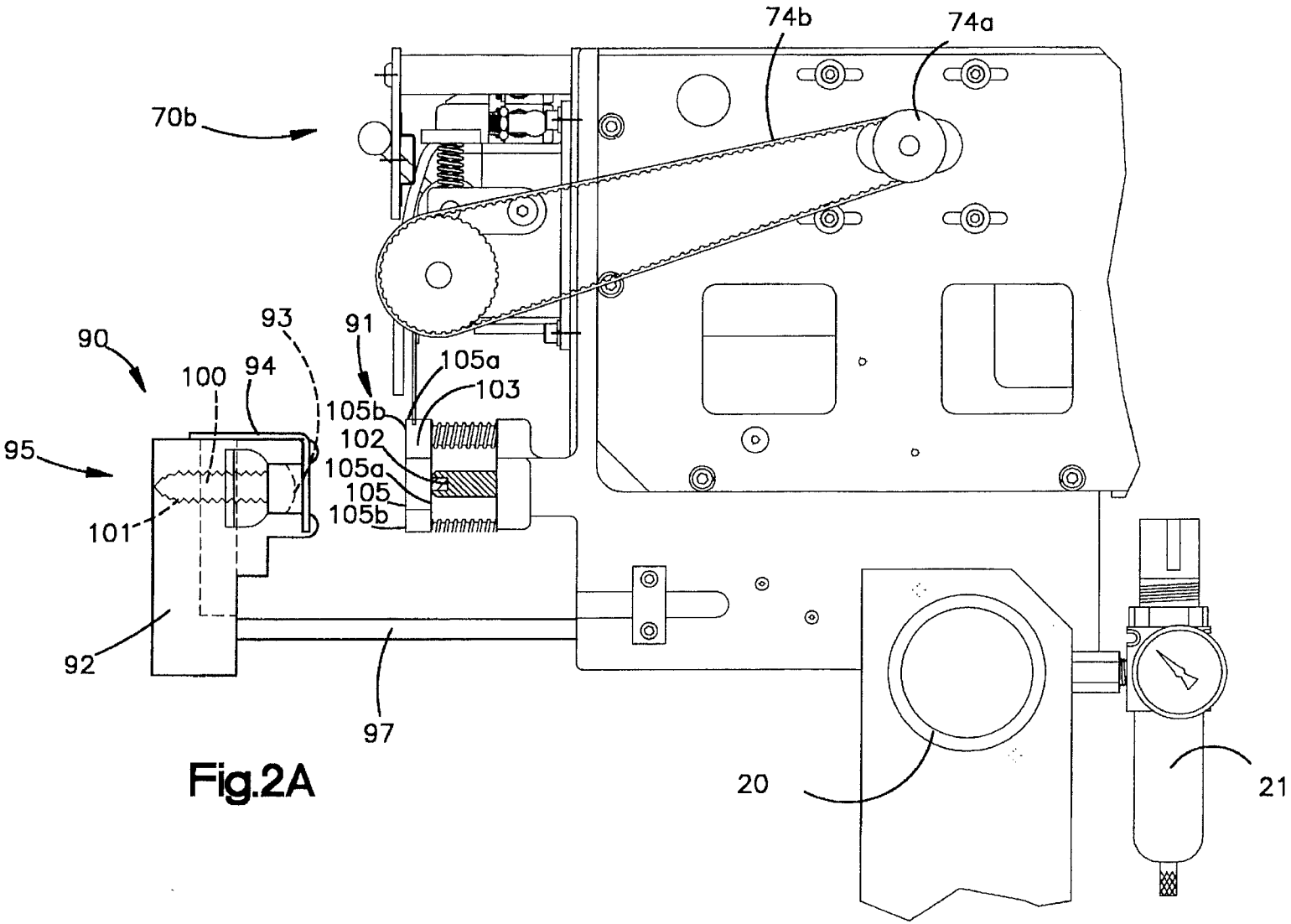
FIG. 2A is an enlarged sectional view of the bagger with parts of the bagger broken away and removed.
Figure 4:
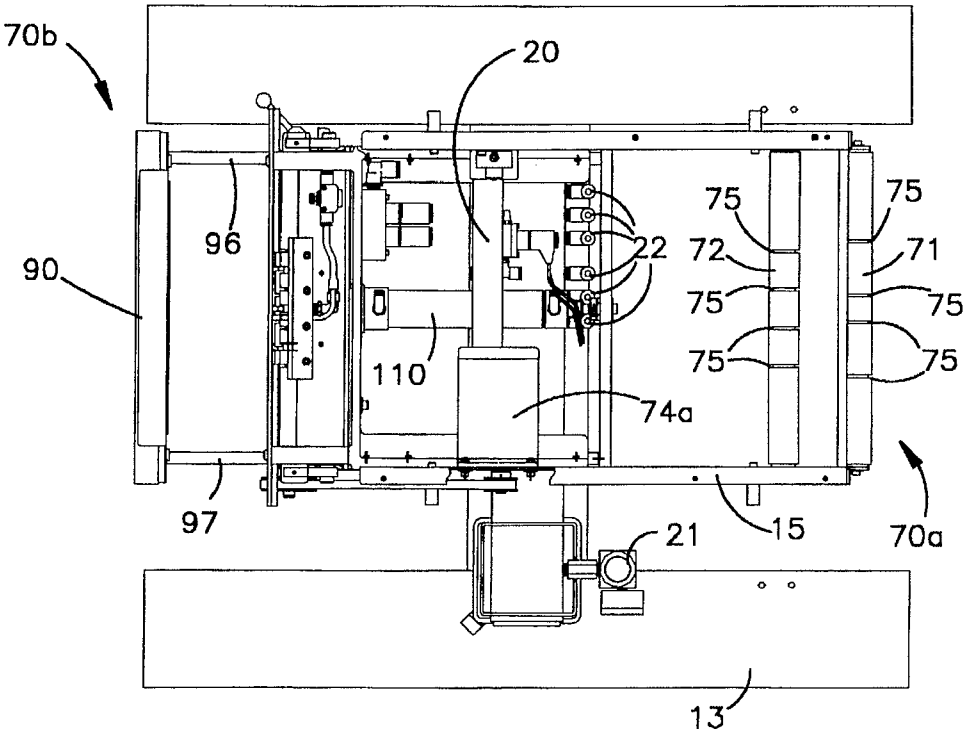
FIG. 4 is a top plan view of the packaging machine of FIG. 1.
Figure 6:
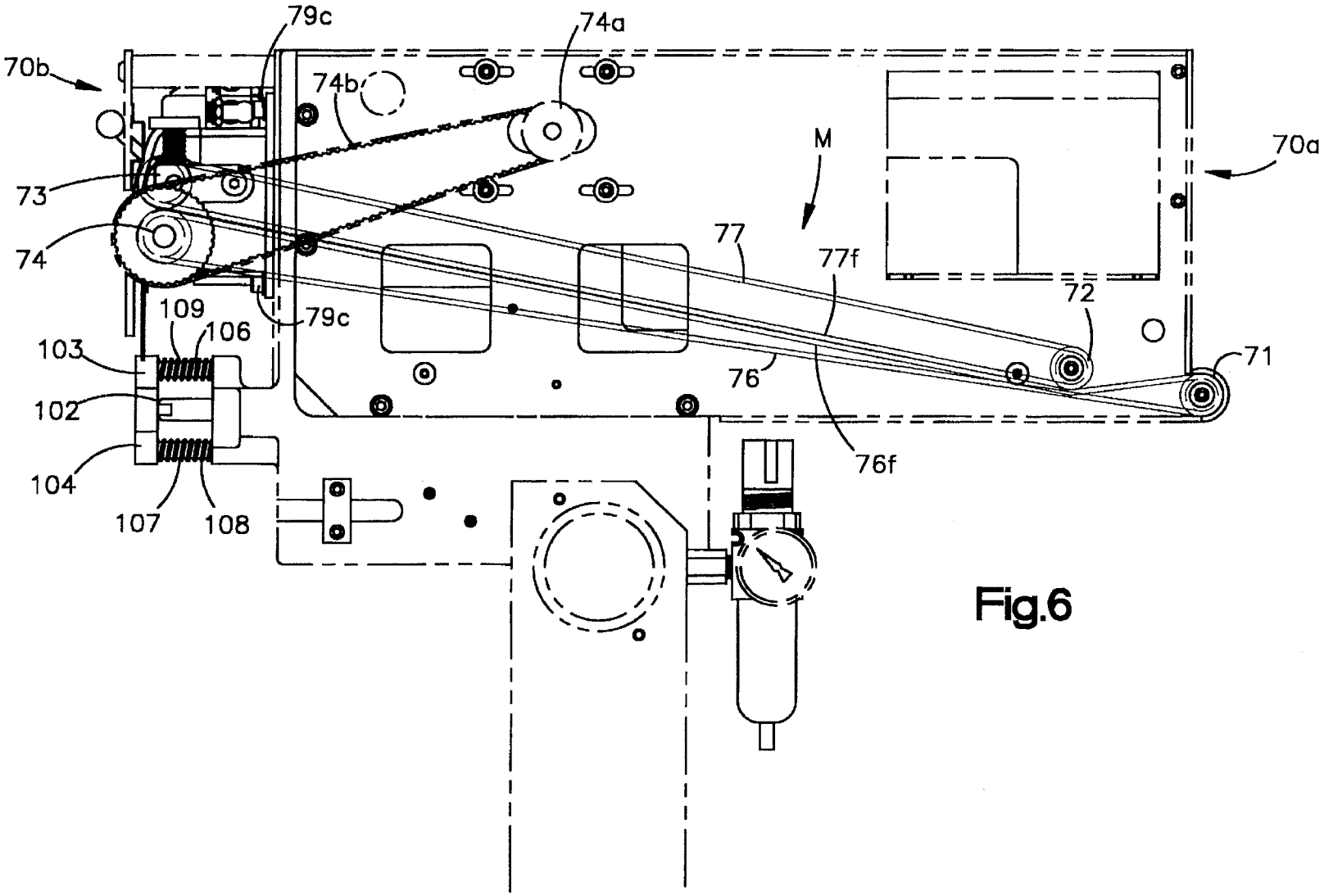
FIG. 6 is an enlarged sectional view of a bagger of the packaging machine of FIG. 1 with parts of the bagger broken away and removed.

As best seen in FIGS. 2, 4 and 6, after the web travels under the third upper dancer roll 41*c*, it travels upwardly through a second section of the web path to the bagger 15. Optionally, accessory devices (not shown) may be positioned along the second section. The bagger feed mechanism M functions to isolate downstream tensional effects from the second section so that the mechanism M and the nip roll assembly of the device 17 cooperate to isolate this second section from up- and downstream tensional forces.

The feed mechanism M defines a third section of the web path of travel. An idler roll 71 over which the web 11 is fed delineates the upstream end of the mechanism M. A second idler roll 72 is further along the web path of travel within the bagger. A pair of load station nip rolls 73, 74, with the roll 74 being a driven roll, are positioned adjacent an output end 70*b* of the bagger 15.

Grooves 75 are defined in each of the rolls 71, 72, 73, 74. Four lower elastic belts 76 are around the rolls 71, 74 and in their grooves 75 to provide a lower web conveyor. Four upper elastic belts 77 are around the rolls 72, 73 and in their grooves 75 to provide a co-acting upper web conveyor.

The upstream rolls 71, 72 are offset, both longitudinally and laterally of the web path with the axis of the upstream lower conveyor roll 71 located above the plane of an upper conveyor feed reach 77*f*. While the location of the lower conveyor roll 71 may be adjusted, in the preferred and disclosed arrangement it is located in a plane that contains the axes of the upper conveyor rolls 72, 73. Because of the offset of the roll 71, the lower belts 76 are stretched around and in contact with an underside of the roll 72. The upper conveyor belts 77 are elongate oval in shape while belts 76 are otherwise configured because of the contact with the upper belt roll 72.

The bending of the lower belts 76 over the upstream upper belt roll 72 assures a positive clamping of a web being fed against the upper roll and positive frictional engagement of the belt with a web being fed through the bagger. This frictional engagement at the upper rearward roll 72 contributes to two of the outstanding features of the invention. First, it isolates downstream tensional forces from upstream sections of the web and thus, delineates a division between the second and third sections of the web path of travel. In addition, the assured frictional engagement with the belt permits the bagger feed mechanism M to grasp a web and self-thread it through the mechanism M to a load station adjacent the nip rolls 73, 74. Further, by reversing the direction of belt rotation, one may readily unthread the machine to facilitate change over to a different web or correct a realalignment should it occur as a web is self threaded.

The dimensioning of the nip rolls 73, 74 provides another of the outstanding features of the invention. The radial depth of the grooves 75 in these nip rolls is slightly greater than the diameter of the belts 76, 77. Thus, the diameters of the rolls 73, 74 are slightly greater than the diametrical dimension of the belts as they are reeved around the nip rolls and disposed in the grooves with the result that the lineal surface speed of the rolls 73, 74 at their line of nip engagement is slightly greater than the surface speed of feed reaches, 76*f*, 77*f*. This speed differential provides several outstanding advantages. First, it provides positive web tensioning through the third section in the path of travel between the feed reaches 76*f*, 77*f*. This assures proper alignment of the web throughout the bagger feed mechanism M. In addition, since the upper face of the web, as viewed in FIG. 6, contains the open bag fronts, the speed differential between the nips and the belts slightly pre-opens the bags, greatly facilitating the speed and completeness of bag opening at the load station.

The Nip Roll Sub-Assembly

Figure 8:
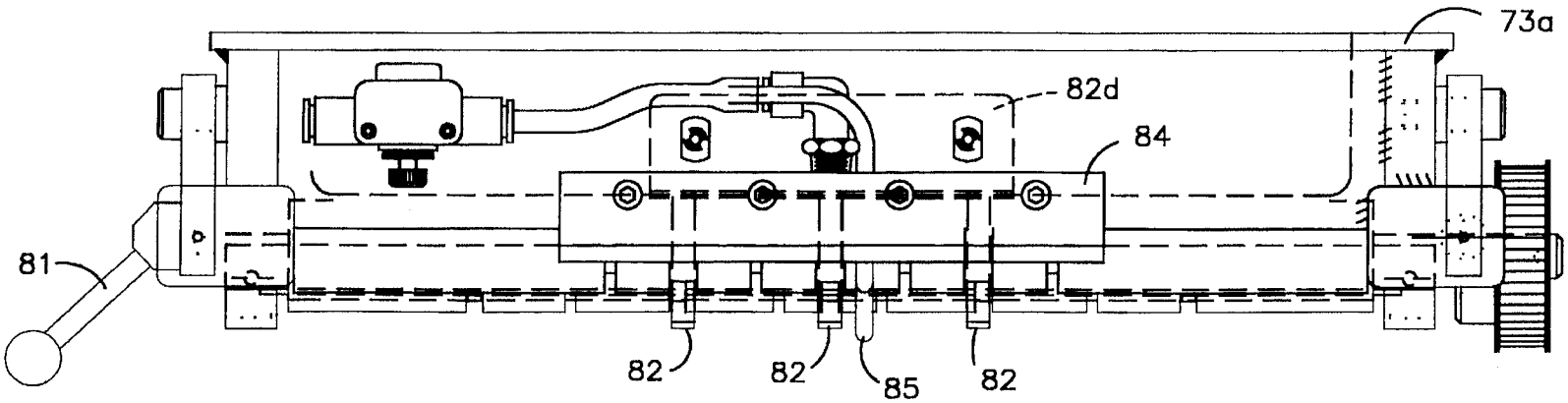
FIG. 8 is a top plan view of the nip roll drive assembly of FIG. 7.
Figure 7:
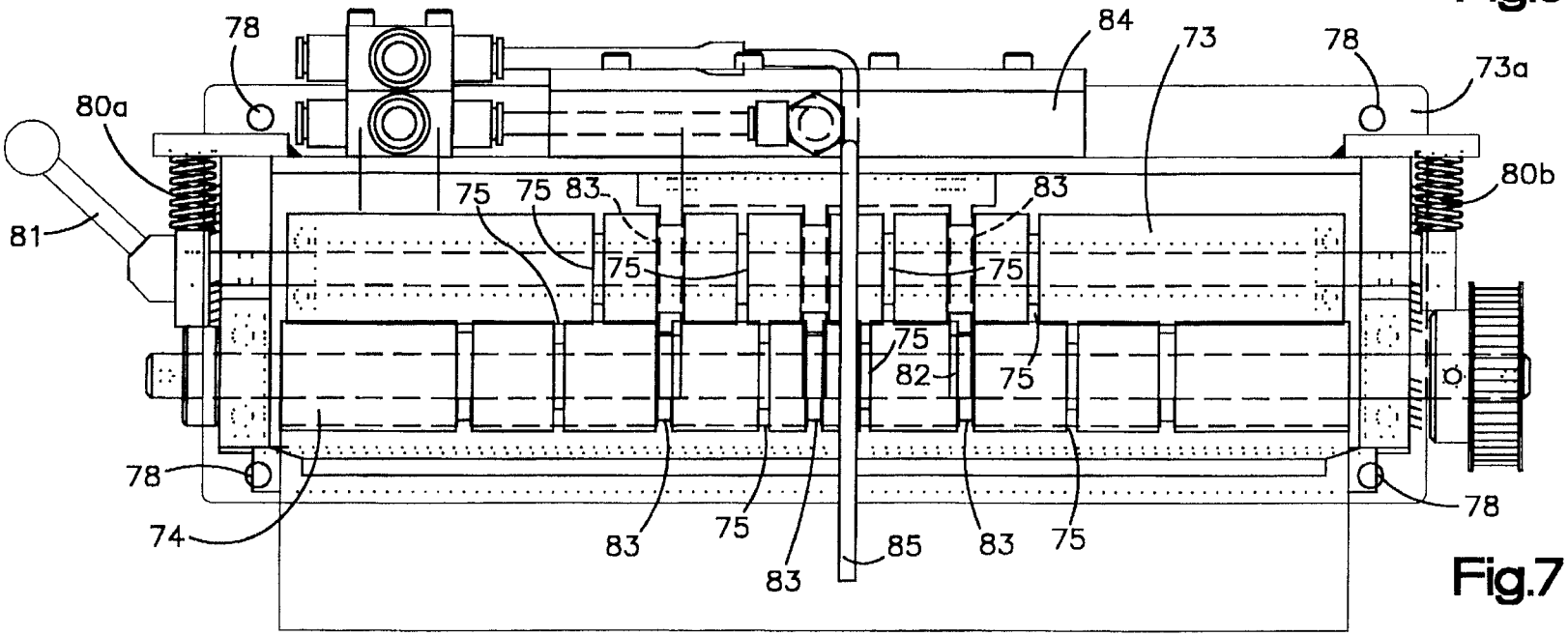
FIG. 7 Is an enlarged elevational view of a nip roll drive assembly of the bagger of FIG. 6.
Figure 10:
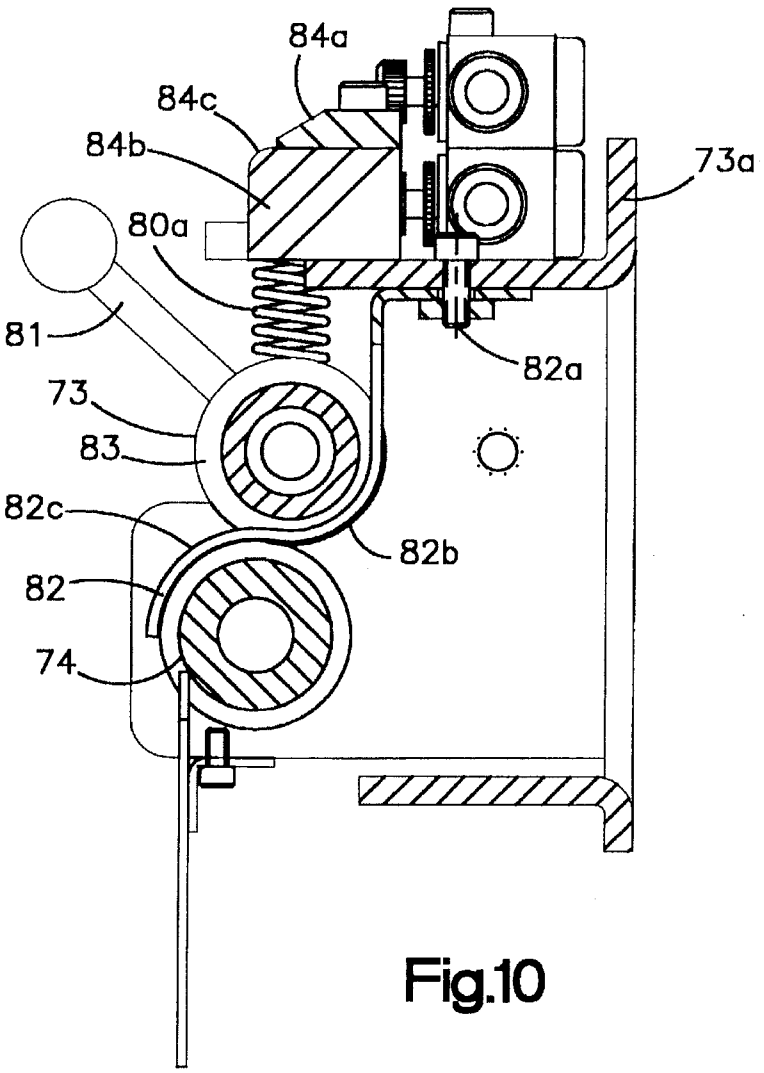
FIG. 10 is a cross sectional view of the nip drive roll assembly of FIG. 7 as seen approximately from the plane indicated by the line 10—10 in FIG. 7.
Figure 9:
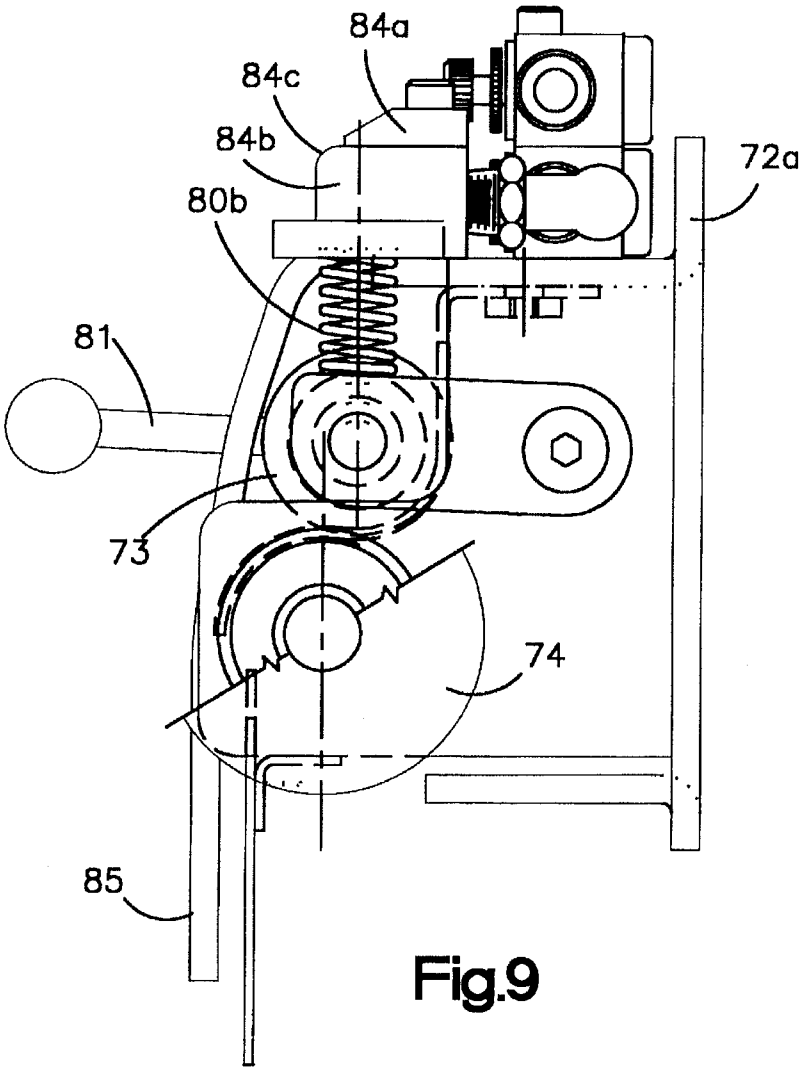
FIG. 9 is a side elevational view of the drive assembly of the nip roll of FIG. 7.

As best seen in FIGS. 8–10, the upper nip roll 73 is offset rearwardly along the path of travel with respect to the drive roll 74. The nip roll 73 is nipped against the drive roll by springs 80*a*, 80*b*. A lever 81 is connected to an outer shaft of the nip roll 73 in a camreed relationship such that movement of the lever selectively from its position in FIG. 10 to its position in FIG. 9 will cause the nip roll 73 to be separated from the drive roll 74 as shown in FIG. 9. This separation facilitates machine service and maintenance.

Figure 15:
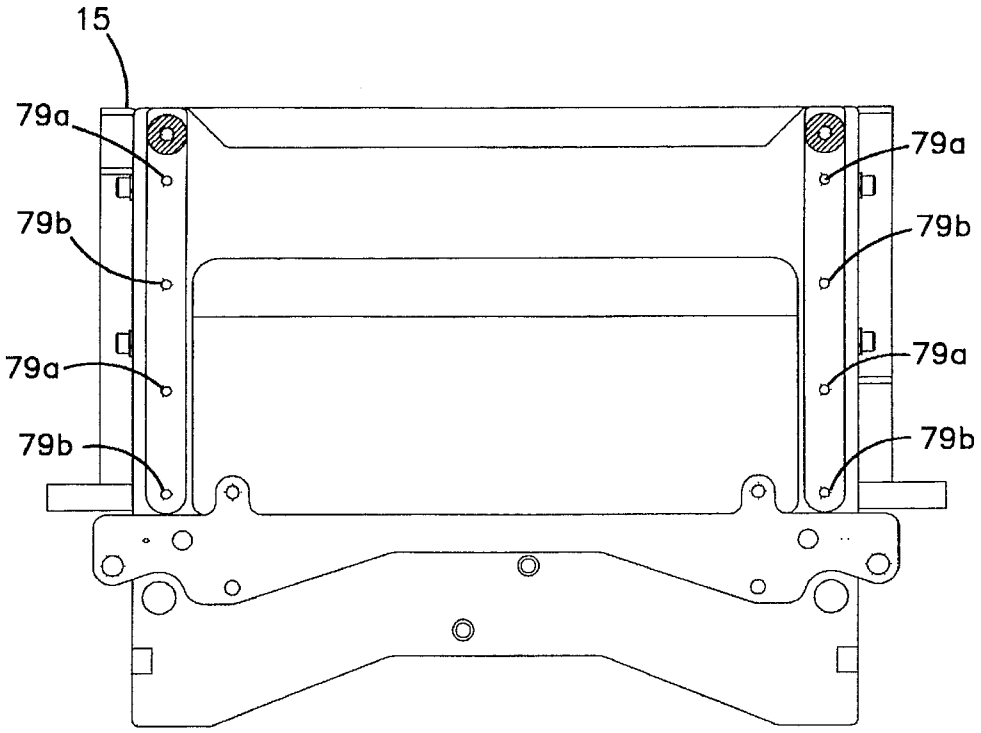
FIG. 15 is an enlarged front elevational view of a frame of the bagger illustrated in FIG. 6.
Figure 14:
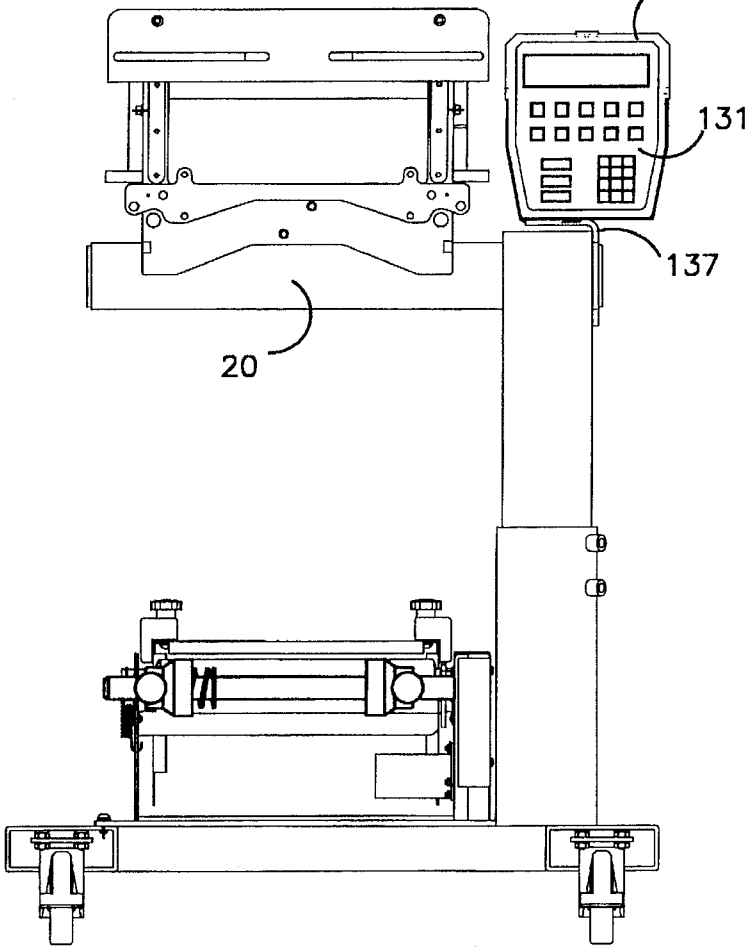
FIG. 14 is a front elevational view of the packaging machine of FIG. 1 with the nip drive roll assembly and a sealing section removed.

The nip roll 73 and the drive roll 74 are connected to a support 73*a* to form a nip roll sub-assembly. The nip roll sub-assembly can be mounted in a selected one of two locations based upon operator choice. Four holes 78 are aligned with either of two sets of holes 79*a*, 79*b* (See FIG. 15) located on the bagger 15. Bolts 79*c* (two of four are shown) are used to secure the nip roll sub-assembly in its selected location on the bagger.

Figure 16:
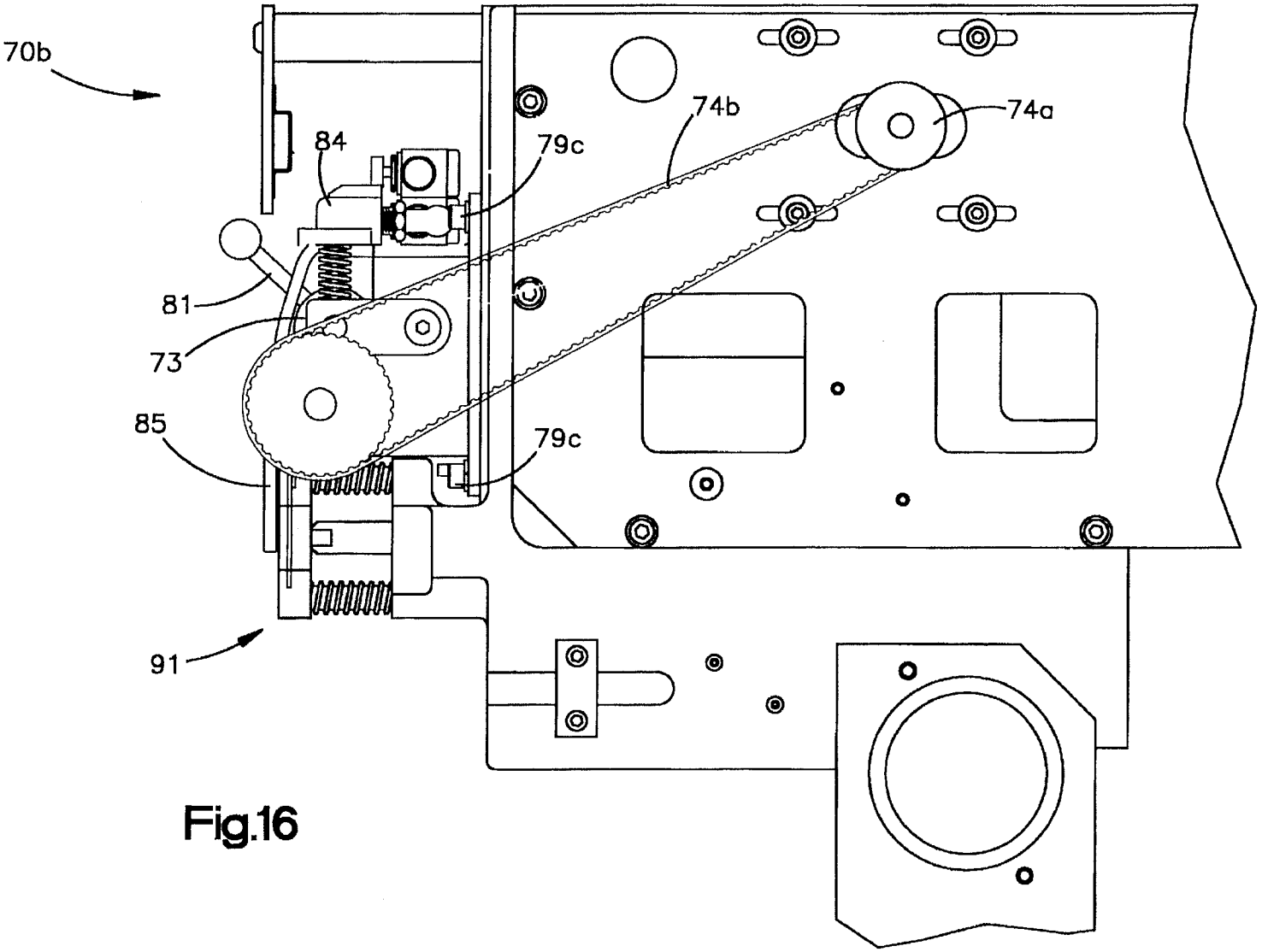
FIG. 16 is an enlarged sectional view of the bagger with parts of the bagger broken away and removed and illustrating the drive roll assembly mounted in an alternate location.

FIG. 16 illustrates the nip roll sub-assembly mounted in its lower position and connected to the holes 79*b*. A longer belt 74*b* is required to connect the roll 74 and the stepper motor 74*a* in the lower position than is the case in the upper position.

A set of three fingers 82 is secured to the support 73*a* by fasteners 82*a*, FIG. 10. The fingers 82 depend from the support 73*a* and then extend forwardly through arcuately curved sections 82*b* disposed in grooves 83 formed in the upper nip roll 73. The fingers extend further forwardly and downwardly through a second set of arcuately curved sections 82*c* which are complementally, closely adjacent the lower nip roll 74. The lower finger sections 82*c* serve as web deflectors to deflect the web downwardly and assure appropriate positioning of each bag to be loaded at the load station.

A spark gap detector 82*d* is positioned slightly upstream from the nip rolls 73, 74 and co-acts with the fingers 82 to sense web perforations that delineate lines of weakness between successive bags. The web normally acts as an insulator preventing spark travel between the sensor and the fingers. When the perforations pass between the fingers and the sensor, arcs travel through the web from the sensor to the fingers, thereby providing a signal for registration of a bag in position to be loaded. Because the bags are slightly pre-opened by the tension created by the drag of the belts 76, 77, offset perforations at an upstream location in the backs of the bags can be detected by the sensor.

The Air Knife System

An air knife 84 is in communication with the air manifold defined by the support frame 12 and support arm 20. The air knife is commercially available from Exair Corporation, 1250 Century Circle North, Cincinnati, Ohio 45246 under Part No. X032092. An air tube 85 is also in communication with the air manifold. After a bag passes between the nip rolls 73, 74 and is in a position for loading, a burst of air from air tube 85 opens the bag while a steady, laterally elongate, stream of air from the air knife completes and maintains the opening of the bag.

The air from the air knife passes from between upper and lower portions 84*a*, 84*b*, FIG. 10. After the air passes between these two portions, it travels over and around a radiused corner 84*c* of the lower portion 84*b* and along a front side of the air knife and into the bag. Because of the long, lateral dimension of the air knife, it provides a sheet of air under low pressure thereby creating a thorough side-to-side opening of the bag.

While the bag is held open by the air knife 84, a product may be either manually or automatically loaded into the bag. Once the product has been loaded into the bag, a solenoid 86 terminated the flow of air through the air knife 84. As the air flow is stopped, a clamping sub-assembly 90 is moved in against the bag causing the bag to move against a heater bar sub-assembly 91, FIG. 2.

The Clamping and Heater Bar Sub-Assemblies

The clamping sub-assembly 90 is connected to the machine 10 by guide rods 96, 97. The sub-assembly 90 includes a support 92 and a seal pad 93 connected to the support, FIG. 2. A seal pad housing 94 is connected to the support 92 via lost motion connections (one of which is shown at 95). The lost motion connections each include a pin 100 and a spring 101.

The heater bar sub-assembly 91 includes a heater bar 102 protected by a conventional Teflon® cover. Upper and lower gripper plates 103, 104 flank the heater bar. Each of the gripper plates 103, 104 has a flat surface 105. The plates are mounted on the bagger 15 by bolts 106, 107 that are surrounded by springs 108, 109. Upper and lower edges 105*a*, 105*b* of the plates are sharpened and serrated.

A jam prevention system is provided and includes two reflective devices located on the clamping sub-assembly, a light beam emitter and a light beam receiver. The structure and operation of the jam prevention system is more fully described in a co-pending patent application, which is incorporated herein in its entirety by reference, entitled "Packaging Machine and Method," Ser. No. 07/954,305, filed concurrently herewith now U.S. Pat. No. 5,289,671 granted Mar. 1, 1994 and owned by a common assignee.

The clamping sub-assembly 90 is moved against the heater bar subassembly 91 by an air cylinder 110. The air cylinder 110 is in fluid communication with the air manifold within the support frame 12 and support arm 20. The seal pad housing 94 compresses against its lost motion connections and the seal pad 93 clamps a loaded bag against the gripper plates 103, 104 and thence against the heater bar 102. While the loaded bag is clamped between the subassemblies, the stepper motor 74*a* reverses the web feed thereby separating the loaded bag from the web.

The Electronic Controls

Figure 17:
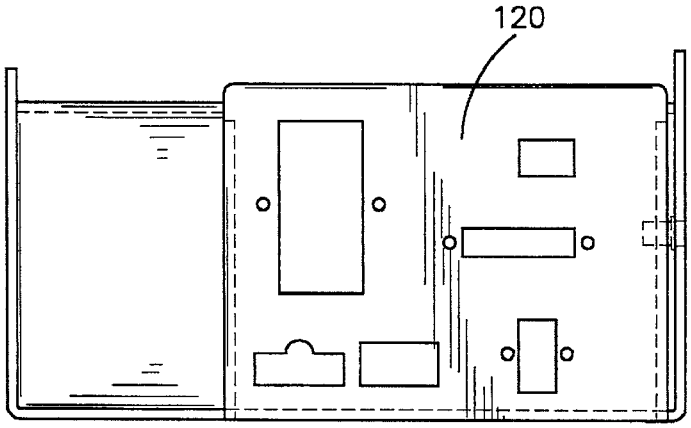
FIG. 17 is a rear elevational view of a housing for the electronic controls of the packaging machine.
Figure 18:
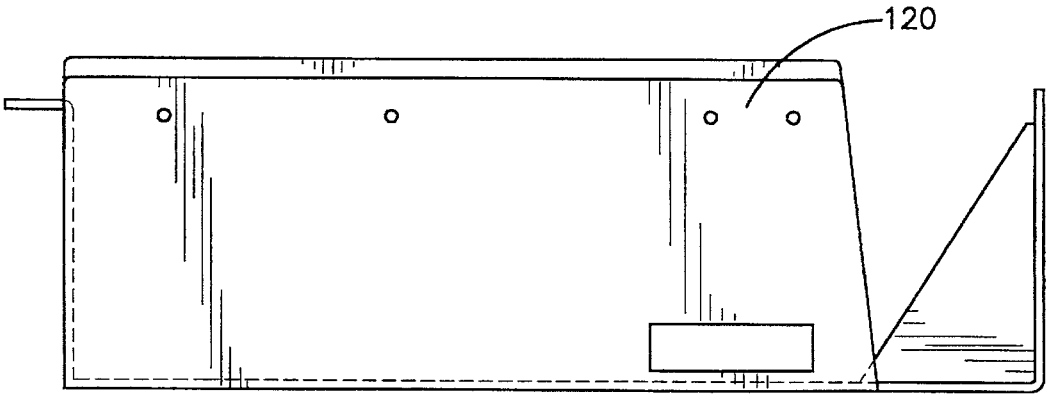
FIG. 18 is a side elevational view of the housing for the electronic controls of the packaging machine.
Figure 19:
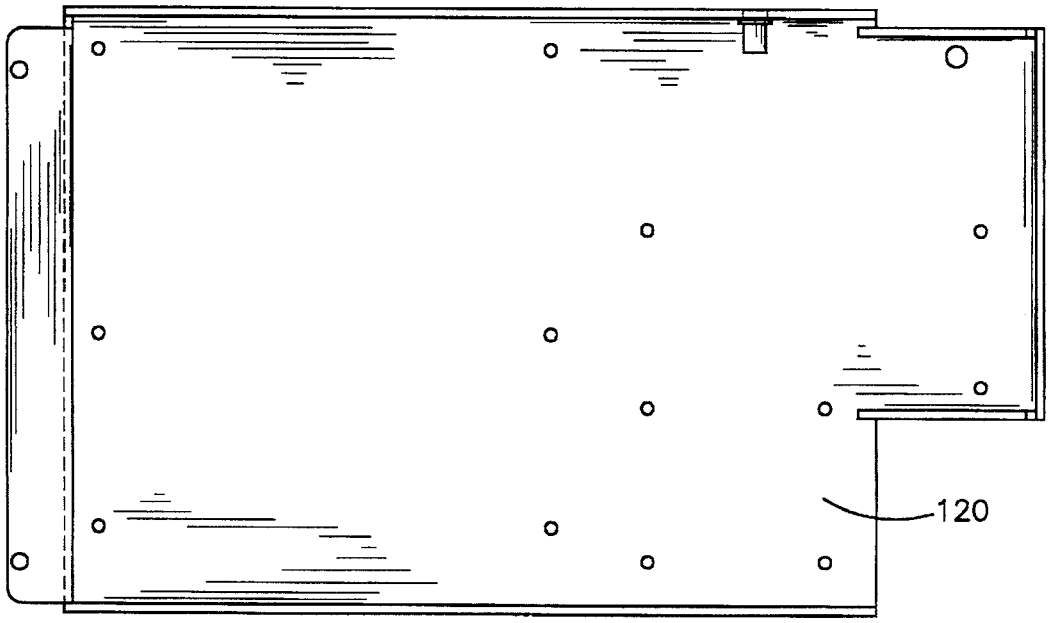
FIG. 19 is a top plan view of the housing for the electronic controls of the packaging machine.

Electronic controls for the machine 10 are contained within a housing 120 that is illustrated in FIGS. 17–19. The controls include a controller board defining a bus system and one or more auxiliary boards coupled to the bus system. The housing 120 is a removable section of the bagger 15 and therefore can easily be removed as a unit for maintenance and service as opposed to individually removing electrical circuit boards or other components. The structure and operation of the electronic control system of the machine 10 is more fully described in a co-pending patent application, which is incorporated herein in its entirety by reference, entitled "Bagging Control Apparatus and Method," Ser. No. 07/936,925 filed Aug. 27, 1992 and now U.S. Pat. No. 5,341,625 granted Aug. 30, 1994 and owned by a common assignee.

An input module 130 is connected to the support frame 12. The input module 130 includes a keypad 131 that allows operator input for programming and controlling the machine 10.

The bagger 15 and input module 130 are individually pivotable as illustrated in phantom in FIG. 1. Two screws 132, 133 are respectively contained within slots 134, 135 located within a portion of a module support bracket 136. By loosening the screws 132, 133, the module can be rotated about an extension of the tube 201 to position the keypad at a desired orientation.

Split clamps 137, FIG. 5, rotatively fix the bagger 15 at a desire orientation on the tube 20. Loosening of cap bolts 139 (only one of four being shown in FIG. 5) allows the bagger to be rotated to a desired orientation and then clamped in that orientation.

Although the preferred embodiment of this invention has been shown and described, it should be understood that various modifications and rearrangements of the parts may be resorted to without departing from the scope of the invention as disclosed and claimed herein.

We claim:

1. A method of opening individual bags of a flattened web of bags having preformed load openings for loading the bags at a load station of a packaging machine comprising the steps of:

a) feeding the web through the packaging machine from a supply station to a load station;

b) with a first mechanism pre-opening individual bags slightly by applying an accelerating force to a face of each bag as it approaches the load station;

c) following the preopening with a second mechanism further opening each such preopened individual bag sufficiently to enable facile insertion of a product to be packaged;

d) successively inserting a least one product in each opened bag; and, e) thereafter closing the bag.

2. A method of opening individual bags of a flattened web of bags having preformed load openings for loading the bags at a load station of a packaging machine comprising the steps of:

a) feeding the web through the packaging machine from a supply station to a load station;

b) pre-opening the load openings of individual bags slightly by applying an accelerating force to a face of each bag as it approaches the load station while maintaining tension within the web; and c) thereafter opening individual bags in the load station fully with a stream of air.

3. A process of packaging products in bags from a flattened web of bags having preformed load openings comprising:

a) feeding the web along a path of travel from a supply to a loading station at least in part by frictionally engaging the web between opposed moving belts;

b) preopening an end one of the bags of the web as it approaches the load station by frictionally engaging the end bag near its opening with an element moving with a surface speed in the direction of web travel greater than the speed of web travel;

c) further opening the end bag;

d) inserting a product into the end bag; and, e) closing the end bag and separating it from the web.

4. The process of claim 3 wherein the end bag is further opened by directing a flow of air into the end bag.

5. The process of claim 3 wherein the element is a grooved roller which engages at least one belt.

6. The process of claim 5 wherein the grooved roller drives said at least one belt.

7. The process of claim 3 wherein the bag closing further includes the step of sealing the end bag.

8. The process of claim 36 wherein the moving belts are provided by a pair of sets of belts.

9. A process of sequentially packaging products in successively positioned bags of a flattened web of bags having preopened faces comprising:

a) feeding the web along a path of travel from a supply to a loading station at least in part by frictionally engaging the web between a pair of sets of moving belts;

b) preopening an end one of the bags of the web as it approaches the load station by frictionally engaging the end bag face near the one opening of the end bag with an element moving with a surface speed in the direction of web travel greater than the speed of web travel;

c) thereafter with a different mechanism further opening the preopened end bag;

d) loading a product into the further opened end bag;

e) closing the now loaded end bag and separating it from the web; and, successively repeating steps (a) through (e) with further bags as each such further bag becomes the end one of the bags.

10. The process of claim 9 wherein the end bag is further opened by directing a flow of air into the end bag.

* * * * *